US009474144B2

(12) United States Patent
Harasimowicz et al.

(10) Patent No.: US 9,474,144 B2
(45) Date of Patent: Oct. 18, 2016

(54) LINEAR ACCELERATOR

(71) Applicant: Elekta AB (Publ), Stockholm (SE)

(72) Inventors: Janusz Harasimowicz, West Sussex (GB); Ian Shinton, West Sussex (GB)

(73) Assignee: ELEKTA AB (PUBL), Stockholm (SE)

( * ) Notice: Subject to any disclaimer, the term of this patent is extended or adjusted under 35 U.S.C. 154(b) by 0 days.

(21) Appl. No.: 14/694,567

(22) Filed: Apr. 23, 2015

(65) Prior Publication Data

US 2015/0313001 A1 Oct. 29, 2015

(30) Foreign Application Priority Data

Apr. 23, 2014 (GB) ..... 1407161.7

(51) Int. Cl.

| | |
|---|---|
| ***H05H 7/22*** | (2006.01) |
| ***H05H 7/02*** | (2006.01) |
| ***H05H 9/04*** | (2006.01) |
| ***H05H 9/00*** | (2006.01) |

(52) U.S. Cl.

CPC ..... *H05H 7/22* (2013.01); *H05H 7/02* (2013.01); *H05H 9/00* (2013.01); *H05H 9/048* (2013.01); *H05H 2007/025* (2013.01); *H05H 2007/227* (2013.01); *H05H 2277/11* (2013.01)

(58) Field of Classification Search

CPC ..... H05H 7/18; H05H 9/04; H05H 9/00; H05H 7/22; H05H 7/02; H05H 7/12; H05H 2007/008

See application file for complete search history.

(56) References Cited

U.S. PATENT DOCUMENTS

2013/0113503 A1* 5/2013 Ruf ..... G01T 1/29 324/654

OTHER PUBLICATIONS

S. Molloy et al., High precision superconducting cavity diagnostics with higher order mode measurements, Phys. Rev. ST Accel. Beams 9, 112802 (2006), http://link.aps.org/doi/10.1103/PhysRevSTAB.9.112802.

(Continued)

*Primary Examiner* — Jany Richardson

(74) *Attorney, Agent, or Firm* — Finnegan, Henderson, Farabow, Garrett & Dunner, LLP

(57) ABSTRACT

A linear accelerator is disclosed, having a series of interconnected cavities through at least some of which an rf signal and an electron beam are sent, comprising at least one variable coupler projecting into the a cavity of the series, a control apparatus adapted to interpret an electrical signal from the coupler and derive diagnostic information as to the electron beam therefrom, wherein the control apparatus is further adapted to vary the interaction of the at least one coupler with the rf signal in dependence on the diagnostic information. Thus, the accelerator properties can be adjusted by encouraging or inciting an Higher-Order Mode ("HOM") having a desired effect such as bunching and/or deflecting. The coupler could be rotateable, and partially or fully retractable, to allow its influence to be adjusted and/or for it to be removed from service when not needed. Several such probes could be available, approaching the cavity from different directions or at different locations, or approaching different cavities. The coupler can be asymmetric, in order to exert an appropriate influence on the cavity and provoke a useful HOM. For example, it can be elongate with at least one directional deviation, such as a hockey stick. Generally, however, the appropriate shape for the coupler will be dependent on the shape of the cavity with which it is working and the specific HOMs that are to be excited.

20 Claims, 3 Drawing Sheets

(56) References Cited

OTHER PUBLICATIONS

G. Burt et al., Copper prototype measurements of the HOM, LOM and SOM couplers for the ILC Crab Cavity, Proceedings of EPAC08, MOPP009 (2008).

S. Posen et al., HOM measurements with beam at the cornell injector cryomodule, Proceedings of 2011 Particle Accelerator Conference, TUP063 (2011).

P. McIntosh et al., An over-damped cavity longitudinal kicker for the PEP-II LER, SLAC-PUB-10087, 2003.

W.K. Lau, A new kicker for the TLS longitudinal feedback system, Proceedings of 2005 Particle Accelerator Conference (2005).

L.H. Chang et al., Development of the RF Kicker for the Longitudinal feedback system at SRRC, 6th European Particle Accelerator Conference, 1998, pp. 1708-1710.

* cited by examiner

LINEAR ACCELERATOR

CROSS-REFERENCE TO RELATED APPLICATION

This application is based upon and claims the benefit of priority to Great Britain Application No. GB 1407161.7, filed on Apr. 23, 2014, the entire contents of which are incorporated herein by reference.

FIELD OF THE INVENTION

The present invention relates to a linear particle accelerator (or "linear accelerator").

BACKGROUND ART

Linear accelerators (especially those for medical use) accelerate subatomic particles such as electrons to relativistic speeds along an evacuated conduit. Typically, the conduit uses a tuned-cavity waveguide in which a radio-frequency (rf) standing wave is established in order to accelerate the electrons. The electrons arrive at one end of the accelerator from an electron gun such as a thermionic device or a photocathode, and pass through a series of cavities defined within a conductive material and which therefore contain the rf standing wave, one half-phase per cavity. The cavities are sized so that the electrons traverse each cavity in exactly half the time period of the standing wave. Thus, by the time they arrive in the next cavity, which will be in anti-phase with the preceding cavity, the standing wave is at the opposite phase point, i.e. has reversed. The electrons thus always see an electrical field of the same polarity and are accelerated along the length of the accelerator. The dimensions of each cavity are chosen to match the speed of the electrons at that point along the accelerator. They are thus initially shorter in length, becoming longer and more uniform in length as the electrons approach relativistic speeds.

To ensure efficient and smooth operation of the accelerator, it is therefore important that the electrons remain in "bunches" and at the same predictable speed during their passage along the accelerator. If a group of electrons begins to spread out along the longitudinal axis of the accelerator then the foremost or rearmost electrons in the group will being to "see" the wrong phase of the rf standing wave.

One reason why the bunch of electrons might be perturbed is the presence of electrical fields other than the first-order standing wave that is being used to accelerate them. As the accelerating cavities are usually enclosed within a substantial conductive housing, the presence of external stray fields is unlikely, and thus the main source of other fields is higher-order resonances within the cavity. Such modes might impose a longitudinal acceleration on the bunch, affecting its speed and possibly unbunching it, or a lateral force serving to deflect the beam sideways and off the accelerator axis. Thus, it is seen as important to ensure that such higher-order modes ("HOMs") are inhibited, particularly in commercial or medical accelerators where a steady and uniform beam is relied upon.

SUMMARY OF THE INVENTION

We have realised that, in certain circumstances, the effect of the HOMs could be put to a beneficial use rather than be seen as a purely negative phenomenon. For example, it is usual to have to adjust the lateral location of the beam within the accelerator using so-called "kickers"; W. K. Lau et al describe a kicker for use in an experimental accelerator in "A new kicker for the TLS longitudinal feedback system", Proceedings of 2005 Particle accelerator conference (Reference 5). Accelerators also employ "bunchers" to draw the group of electrons in the beam closer together. Such adjustment is often needed in view of HOMs, in fact, to rebunch the beam or return the beam to the central axis of the accelerator after being deflected therefrom by an HOM. However, we propose that the necessary adjustment could also be achieved by encouraging or inciting an HOM having the desired bunching and/or deflecting effect.

Such encouragement could be achieved by way of an asymmetric perturbation to the rf standing wave. A conductive probe introduced from one side of the accelerator into the accelerating cavities or the conduits between them would suffice. The probe could be earthed, or could be at a selectable elevated voltage, or could be supplied with an appropriate rf signal. The probe could be rotateable, and partially or fully retractable, to allow its influence to be adjusted and/or for it to be removed from service when not needed. Several such probes could be available, approaching the cavity from different directions or at different locations, or approaching different cavities.

Thus, the present invention provides a linear accelerator having an evacuated accelerating path comprising a series of interconnected cavities, through at least part of which an rf signal and an electron beam are sent, comprising at least one variable coupler projecting into the accelerating path, a control apparatus adapted to interpret an electrical signal from the coupler and derive diagnostic information as to the electron beam therefrom, wherein the control apparatus is further adapted to vary the interaction of the at least one coupler with the rf signal in dependence on the diagnostic information.

The coupler can be asymmetric, in order to exert an appropriate influence on the cavity and provoke a useful HOM. For example, it can be elongate with at least one directional deviation, such as a hockey stick or a J profile. Generally, however, the appropriate shape for the coupler will be dependent on the shape of the cavity with which it is working and the specific HOMs that are to be excited. Examples suited to one such design of cavities are set out herein. More generally, the shapes can be arrived out by the use of trial and error and/or simulation techniques.

The coupler may project into a cavity, or into an interconnection between cavities. As described herein, by coupling with higher-order-modes (i.e. an rf mode within the accelerating path other than the fundamental mode), the beam can be diagnosed and controlled.

BRIEF DESCRIPTION OF THE DRAWINGS

An embodiment of the present invention will now be described by way of example, with reference to the accompanying figures in which.

DETAILED DESCRIPTION OF THE EMBODIMENTS

Figure 1A:
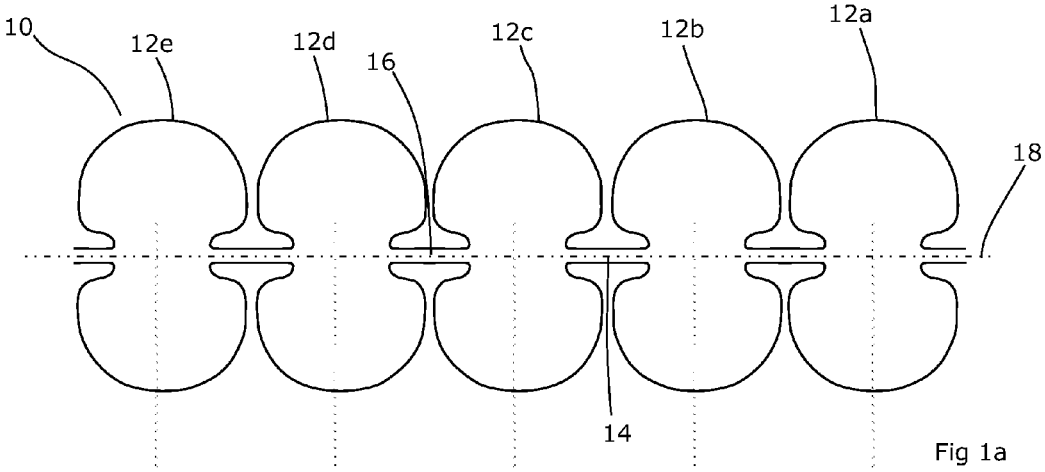
FIGS. 1*a*, 1*b*, 1*c* and 1*d* illustrate the essential principal of a linear particle accelerator.
Figure 1B:
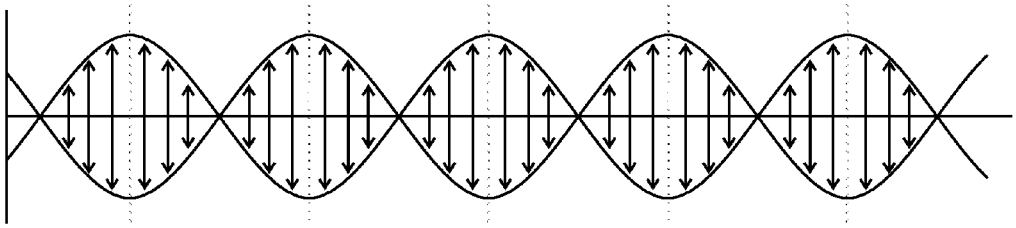
Figure 1C:
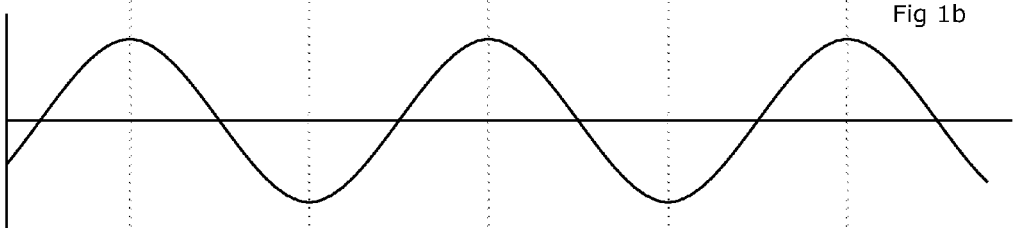
Figure 1D:
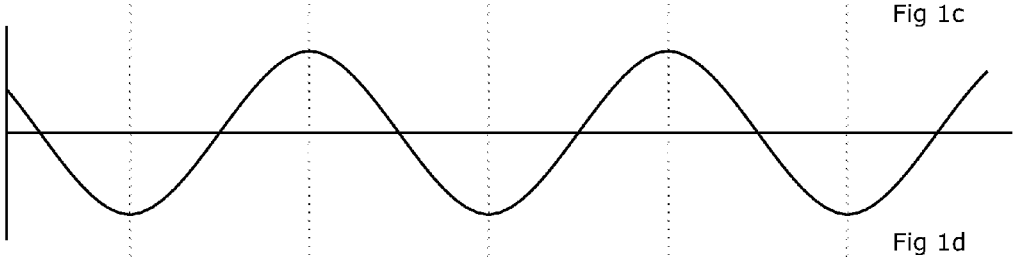

It is critical to properly diagnose any discrepancies and failures in operation of medical linear accelerators (linacs)

not only during their everyday use but also during prototype testing and product commissioning. Two most critical elements which need to be well controlled are radio-frequency (RF) fields and beam dynamics, which are both strongly linked to each other.

Referring to FIG. 1, a typical linear accelerator 10 essentially consists of a series of evacuated accelerating cells 12*a*, 12*b*, 12*c*, 12*d*, 12*e*, of which a small number are shown in FIG. 1. The precise number will vary, dependent on the design criteria of the accelerator, but is often between about 9 and about 30 or more. Each is defined in the form of a recess within a surrounding shell (not shown) of a conductive material, usually copper. Each cell (such as cell 12*c*) has an input port 14 communicating with the preceding cell 12*b* in the sequence and an output port 16 communicating with the next cell 12*d* in the sequence. The ports are centred on the linac axis 18 and the cells are in the form of smoothly rounded toroid, i.e. the shape created by sweeping a shape around the axis 18.

The accelerator structure is supplied with bunches of electrons at its start point, provided by a thermionic emitter or a UV-excited source, for example, and an rf signal is injected into the cavity defined by the multiplicity of cells. The rf signal is reflected at either end of the accelerator in order to create an rf standing wave (FIG. 1*b*), whose properties are set so that the standing wave nodes substantially coincide with the ports 14, 16 and the antinodes lie within the cells 12.

The dimensions of the cells and the standing wave properties are also set so that the standing wave reverses in the same time that is taken for the electron bunch to travel from one cell to the next in sequence. This implies that the early cells in the sequence are slightly shorter, with the differences becoming smaller along the length of the linac as the bunch speed becomes relativistic. Thus, the bunch sees an electrical field component of the rf standing wave in (for example) cell 12*a* (FIG. 1*c*); this accelerates the electrons of the bunch while they are in that cell. By the time the electron bunch has reached the next cell 12*b*, the standing wave has reversed and the electrons again see an electrical field component of the same sign (FIG. 1*d*), and are accelerated again. This process continues, with the reversal of the standing wave coinciding with the bunch passing through the ports 14, 16 and with the bunch being steadily accelerated.

This standing wave as described above, i.e. with a wavelength corresponding to two cells and a frequency corresponding to the time taken for the bunch to traverse two cells, is the fundamental mode or the first order mode for the purposes of this application. Higher order modes are of course possible, but may have deleterious effects on the bunch. For example, if the higher-order mode ("HOM") has an electrical field component aligned with that of the fundamental mode, then the field will vary within an individual cell 12 and may cause the bunch to be spread out. HOMs with an electrical field transverse to the axis 18 may cause the bunch to be diverted off the axis.

Diagnostics of RF cavities can be performed in various ways but the most common technique is based on measurements with probes in air, prior to sealing the accelerating structure. After this phase, only indirect RF diagnostics is usually possible; this has historically tended to be limited to information on the overall performance of the accelerating waveguide, power coupling (reflected signals) and beam output.

Also, the scope for beam diagnostics is somewhat limited in x-ray-producing linacs for medical use, mainly due to space constraints. The beam position is usually deduced from signals measured by a segmented ion chamber placed outside the accelerating structure. The beam energy can be even more difficult to measure; arrangements that use magnetic fields to bend the electron beam can provide feedback on the beam energy, and some systems allow detailed information to be extracted from x-ray measurements, but not all systems include one or both of these.

In any accelerating structure, other electromagnetic modes can be excited in addition to the desired accelerating RF field. These are referred to as higher order modes ("HOMs"). HOMs will create additional electrical and magnetic field variations over and above those described in relation to FIG. 1, and if those variations have a non-trivial component at the linac centreline then they will have an effect on the beam. In general, that effect will be one that is not intended. As a result, HOMs are seen as problematic, and efforts have hitherto been directed toward eliminating HOMs. Typically, this has been done by the careful design of couplers which capture and drain rf energy out of HOMs without substantially affecting the first-order mode. We have realised, however, that HOMs can be used for RF diagnostics and cavity tuning, and for beam diagnostics, alignment and steering.

According to the present invention, on-line measurements of RF harmonics in the accelerating structure are performed in order to observe HOMs. These can be measured in either an unloaded waveguide, i.e. one with no beam present, or a loaded waveguide, i.e. with HOMs induced by the bunches passing through the cavities 12.

Figure 2:
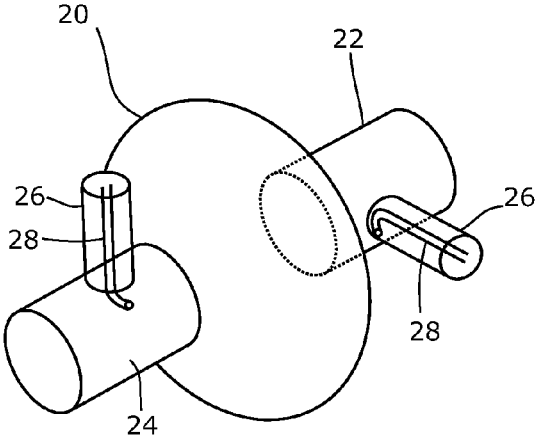
FIGS. 2, 3 and 4 each illustrate differing designs of HOM-coupler.
Figure 3:
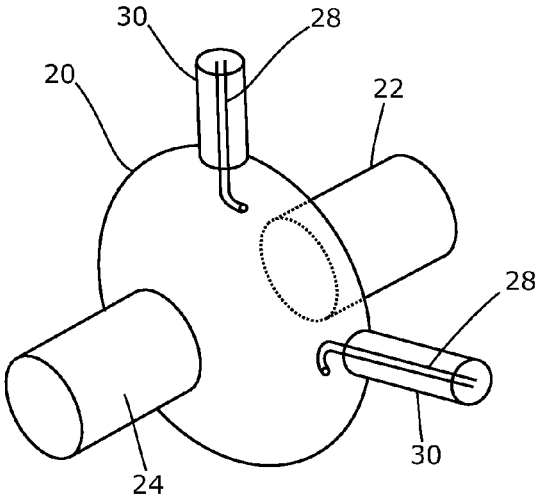

In order to monitor HOMs, conductive (e.g. metal) couplers can be introduced into the linac system. The HOM couplers are ideally designed and tuned to a desired mode of the cavity in question. They can be located at any place along the linac where the electromagnetic mode of interest does not vanish and can be coupled to—in practice, therefore, this will be dependent on the cavity and the mode in question. FIGS. 2 and 3 show examples of HOM couplers of this type. FIG. 2 shows a cavity 20 with an input port 22 and an output port 24. On each port, a side branch 26 is provided to allow a HOM coupler 28 to be inserted and manipulated (through the usual vacuum seals and the like) to extend and withdraw it from the port and/or rotate it. Each coupler 28 consists of a J-profile conductor, i.e. one having a straight stem ending with a 135° bend. A bend of between 45° and 180° is usually of use; the bend may be smooth (as illustrated) or a sharp junction between straight (or less-curved) sections. There may be more or fewer than one bend, and/or the coupler may have two or more forks. FIG. 3 illustrates an alternative arrangement, with similar couplers 28 but inserted via branches 30 that communicate with the cavity 20.

With the HOM couplers incorporated into the design of an accelerating waveguide, the following information can be obtained in a non-invasive manner:

- Q values, for both loaded and unloaded linac cavities.
- Frequency spectrum: direct measurement via the HOM couplers for both, the unloaded (S parameter measurement) and loaded linac (transient signal).
- Beam loading: determined from the difference in the Q measurement for the unloaded and loaded accelerating waveguide.
- Beam position: through the use of the HOM couplers acting as HOM beam position monitors (as described later).
- Beam energy: measured as a voltage difference across the HOM couplers from the start to the end of the linac.

Beam current: inferred from the effect of beam loading within the cavity, since the Q value is proportional to the beam current.

Parameter drift: directly linked to observation of measured parameters over time.

The position of the beam within a medical linac can also be deduced from a HOM couplers signal. If the signal (i.e. the power spectrum) is minimised, then the beam is located at the electrical centre of the mode. The addition of several different HOM couplers enables the beam position with respect to several electrical centres to be ascertained with respect to the true geometric centre of the cavity. The electrical centre of the cavity, cell or any part of the linac can be predetermined from 3D EM field calculations of the structure and used as a point of reference with regards to the true geometric centre of the cavity.

The functionality of the HOM couplers can be extended further, as they can be employed as steering components as well. Typically, HOM couplers are used to extract what are perceived to be dangerous modes that are generated within a linac. These fall into two categories: transverse deflecting modes, and longitudinal HOMs (or series of HOMs). The first, if they couple strongly with the beam, will result in the beam being kicked off axis and can lead to beam break-up. The second, if strongly coupled to the beam, can lead to a dilution of the beam/bunches.

However, if the HOM couplers are instead used to excite these potentially dangerous modes, then the HOM couplers will act as kickers/steerers and will enable the beam to be moved via the aforementioned effects. In this case, the beam is steered using the electromagnetic fields generated directly from the HOM and no external fields are applied. By allowing the HOM coupler to be rotatable, the amount of power or kicking effect of the selected HOM can be directed to move or focus the beam. A looped feedback system can be used in which the HOM coupler, or a series of HOM couplers, are used first as a HOM beam position monitor system ("HOM BPM") to ascertain the position of the beam before the HOM couplers (or series of couplers) are used as HOM kickers. This looped feedback kicker/steering system can act on the proceeding bunch. The HOM couplers mentioned above may either be used as a dedicated or variable system for either or both of the above (HOM BPM or HOM Kicker).

Figure 4:
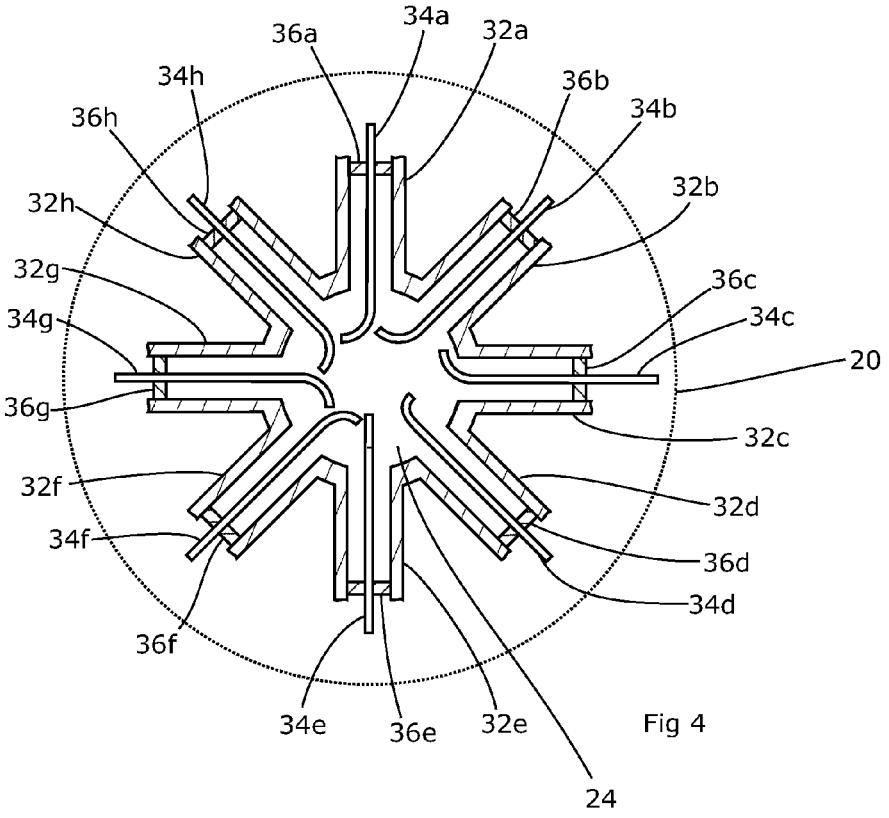

FIG. 4 shows a more complex arrangement of HOM couplers, extending into a port 24 between two cavities 20. A total of eight branches 32*a*-32*h* are arranged around the port, in this case disposed symmetrically and thus at a 45° spacing. A greater or lesser number of branches may be provided, and they may be arranged symmetrically around the port, or not, as necessary. A series of couplers 34*a*-34*h* are provided, each projecting into the port 24 via a respective branch 32 via a vacuum seal 36*a*-36*h*. In this example, all the couplers are identical and in the form of a 90° J-profile, but this is not necessarily the case. The couplers can be withdrawn away from or extended towards the linac centreline, and coupler 34*c* is shown slightly withdrawn (relative to the other couplers). The couplers can also be rotated; as illustrated in FIG. 4 most of the couplers are arranged transverse to the linac axis but coupler 34*d* is rotated 45° and coupler 34*e* is rotated 90°.

This arrangement can be repeated at each port 24, i.e. between each cavity 20, or between selective cavities such as every n cavities, or spaced along the linac. It provides a high degree of sensing and discrimination of HOMs, as the couplers can detect the rf state around the centreline, and a high degree of control as there are two degrees of freedom (position and angle) for each coupler.

In terms of manufacturing, an automated tuning can be implemented that relies on the deviation between the experimental and simulated (idealised, reference) structure of HOMs, and a simplex or similar optimisation routine. The simulated result in question for the idealised structure can be generated using any 3D electromagnetic software package. This tuning process can be used during the construction/testing of both standing and travelling wave linacs and represents a potentially large cost saving in the linac manufacturing process.

Previous efforts have been directed towards identifying HOMs so that they can be eliminated. For example, Molloy et al (Reference 1, below) report a HOM beam position monitoring system that was implemented at the FLASH accelerator facility DESY, Hamburg, Germany, but the linac still relies upon SVD analysis and steering magnets in order to guide the beam. This is different from present solution which is intended for RF and beam diagnostics via the HOM couplers, in which the electrical centre is determined from simulation.

The HOM diagnostics proposed here, such as frequency spectrum and Q measurements, are typically used in bench tests during the manufacturing/construction process (G. Burt et al, Reference 2). What we are proposing is a diagnostic system that relies upon the information gained from the HOM couplers to determine the necessary RF and beam information within the linac.

Other known HOM couplers are designed to remove dangerous modes and have not been applied as outlined herein as a diagnostic and/or steering package. What is known are cavity HOM kickers or steers (P. McIntosh et al, Reference 4 and W. K. Lau, Reference 5) sometimes referred to as drift tube kickers, but these are cavities that have been specifically designed in order to generate a particular HOM to kick/steer the beam, as opposed to generating the HOM via a coupler which is therefore responsive and variable upon demand. Variations of these designs (L. H. Chang et al, Reference 6) combine striplines and an applied voltage/polarity difference to alter the HOM field distribution.

Figure 5:
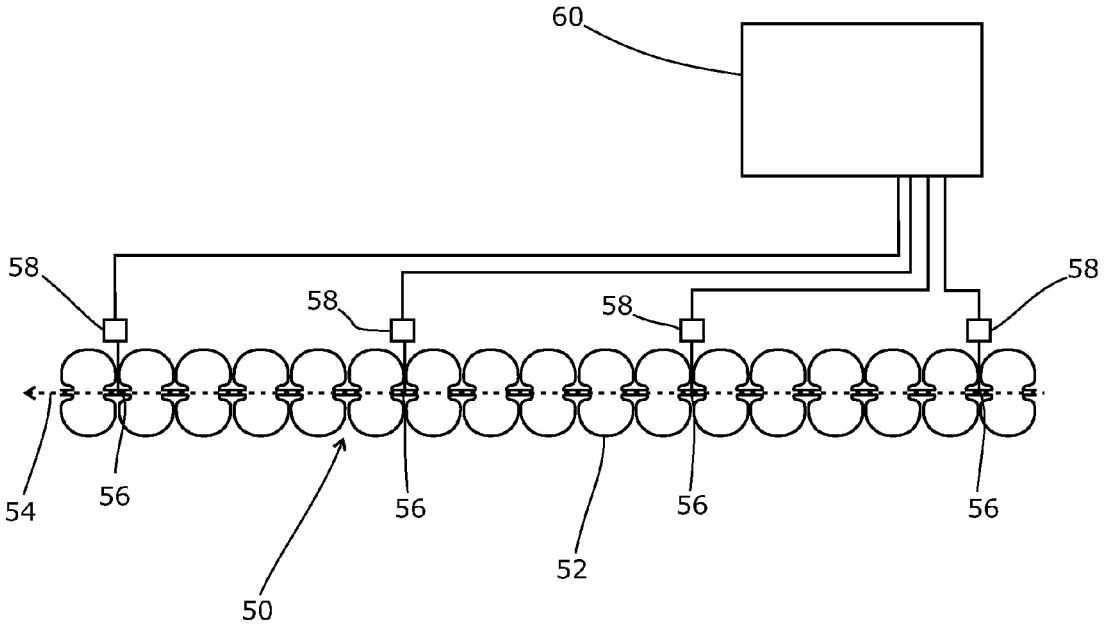
FIG. 5 illustrates the system as a whole.

Thus, FIG. 5 shows the overall system including a linac 50 comprising a series of accelerating cavities 52 along a main axis 54. For simplicity, the cavities shown are identical, but obviously in practice they will have a graduated series of dimensions as noted above. A HOM coupler 56 is provided every fifth cavity; this coupler may be one or more couplers as described in relation to any of FIG. 2, 3 or 4 or otherwise as called for by the characteristics of the linac in question. Each HOM coupler 56 is supported by a coupler control unit 58 which performs any desired positional or angular manipulation of the coupler 56 and sends the sensed voltage signal back to a HOM control unit 60. The HOM control unit 60 interprets the signals received form the couplers 56 and provides diagnostic information as to the state of the linac 50. It can also instruct the coupler control units 58 to move the couplers 56, and supply (or instruct) a voltage or rf signal for application to the couplers 56 in order to manipulate the HOMs as necessary in the light of the diagnostic information or as desired.

It will of course be understood that many variations may be made to the above-described embodiment without departing from the scope of the present invention.

[1] S. Molloy et al, *High precision superconducting cavity diagnostics with higher order mode measurements*, Phys. Rev. ST Accel. Beams 9, 112802 (2006), http://link.aps.org/doi/10.1103/PhysRevSTAB.9.112802

[2] G. Burt et al, *Copper prototype measurements of the HOM, LOM and SOM couplers for the ILC Crab Cavity*, Proceedings of EPAC08, MOPP009

[3] S. Posen et al, *HOM measurements with beam at the cornell injector cryomodule*, Proceedings of 2011 Particle accelerator conference, TUP063

[4] P. McIntosh et al, *An over-damped cavity longitudinal kicker for the PEP-II LER*, SLAC-PUB-10087, 2003

[5] W. K. Lau, *A new kicker for the TLS longitudinal feedback system*, Proceedings of 2005 Particle accelerator conference.

[6] L. H. Chang et al, *Development of the RF Kicker for the Longitudinal feedback system at SRRC*, $6^{th}$ European Particle Accelerator Conference, 1998, pp 1708

The invention claimed is:

1. A linear accelerator having an evacuated accelerating path comprising a series of interconnected cavities, through at least part of which an RF signal and an electron beam are sent, comprising:

at least one variable coupler projecting into the accelerating path; and a controller configured to:

interpret an electrical signal received from the variable coupler;

derive diagnostic information regarding the electron beam sent through the evacuated accelerating path; and vary, based on the derived diagnostic information, an interaction between the at least one variable coupler and the RF signal by varying at least one aspect of the at least one variable coupler.

2. The linear accelerator according to claim 1, wherein the at least one aspect of the at least one variable coupler includes a distance the at least one variable coupler projects into the accelerating path.

3. The linear accelerator according to claim 1, wherein the at least one aspect of the at least one variable coupler includes an orientation of the at least one variable coupler with respect to the accelerating path.

4. The linear accelerator according to claim 1, wherein the at least one aspect of the at least one variable coupler includes an electrical potential of the at least one variable coupler.

5. The linear accelerator according to claim 4, comprising:

an RF signal generator connected to the at least one variable coupler, the RF signal generator being configured to selectively supply an RF signal to the at least one variable coupler.

6. The linear accelerator according to claim 1, wherein the at least one variable coupler is an asymmetric coupler.

7. The linear accelerator according to claim 1, wherein the at least one variable coupler is elongate with at least one directional deviation.

8. A method for controlling a linear accelerator, the linear accelerator having an evacuated accelerating path comprising a series of interconnected cavities, through at least part of which an RF signal and an electron beam are sent, the method comprising:

projecting at least one variable coupler into the accelerating path;

interpreting, by a controller, an electrical signal received from the variable coupler;

deriving, by the controller, diagnostic information regarding the electron beam sent through the evacuated accelerating path; and varying, based on the derived diagnostic information, an interaction between the at least one variable coupler and the RF signal by varying at least one aspect of the at least one variable coupler.

9. The method of claim 8, wherein the at least one aspect of the at least one variable coupler includes a distance the at least one variable coupler projects into the accelerating path.

10. The method of claim 8, wherein the at least one aspect of the at least one variable coupler includes an orientation of the at least one variable coupler with respect to the accelerating path.

11. The method of claim 8, wherein the at least one aspect of the at least one variable coupler includes an electrical potential of the at least one variable coupler.

12. The method of claim 11, comprising:

supplying, by an RF signal generator connected to the at least one variable coupler, an RF signal to the at least one variable coupler.

13. The method of claim 8, wherein the at least one variable coupler is an asymmetric coupler.

14. The method of claim 8, wherein the at least one variable coupler is elongate with at least one directional deviation.

15. A linear accelerator, comprising:

a coupler projecting into an accelerating path; and a controller configured to:

receive an electrical signal from the coupler;

determine diagnostic information associated with an electron beam travelling through the accelerating path; and control the coupler to vary at least one aspect of the coupler based on the diagnostic information.

16. The linear accelerator of claim 15, wherein the at least one aspect of the coupler includes a distance the coupler projects into the acceleration path.

17. The linear accelerator of claim 15, wherein the at least one aspect of the coupler includes an orientation of the coupler with respect to the acceleration path.

18. The linear accelerator of claim 15, wherein the at least one aspect of the coupler includes an electrical potential of the coupler.

19. The linear accelerator of claim 15, comprising:

a signal generator connected to the coupler, the signal generator being configured to supply an RF signal to the coupler to vary the at least one aspect of the coupler.

20. The linear accelerator of claim 15, wherein the coupler is an asymmetric coupler.

* * * * *